US011873015B1

(12) United States Patent
Abdalla et al.

(10) Patent No.: US 11,873,015 B1
(45) Date of Patent: Jan. 16, 2024

(54) TRAIN FOR RELIGIOUS SITE

(71) Applicant: KING FAISAL UNIVERSITY, Al-Ahsa (SA)

(72) Inventors: Rabab Refat Abdalla, Al-Ahsa (SA); Hamdah Ayed S. Alruwaili, Al-Ahsa (SA); Marwan Mohamed Alshamy, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/226,473

(22) Filed: Jul. 26, 2023

(51) Int. Cl.
*B61B 5/00* (2006.01)
*B61B 1/02* (2006.01)
*E01B 25/06* (2006.01)

(52) U.S. Cl.
CPC ..... *B61B 5/00* (2013.01); *B61B 1/02* (2013.01); *E01B 25/06* (2013.01)

(58) Field of Classification Search
CPC ..... B61B 5/00; B61B 1/02; E01B 25/06
See application file for complete search history.

(56) References Cited

U.S. PATENT DOCUMENTS 4,057,017 A * 11/1977 Michalon ..... B61C 13/04 198/324
4,703,697 A * 11/1987 Bell ..... B61C 11/06 104/23.1
4,781,119 A * 11/1988 Davis ..... B60L 13/006 180/2.2
10,625,656 B1 * 4/2020 Golden ..... B61D 1/04
2007/0251407 A1 * 11/2007 Gabriel ..... B61B 1/02 104/180
2012/0085612 A1 4/2012 Churchill

FOREIGN PATENT DOCUMENTS

CN 215154626 U * 12/2021
EP 1554210 B1 12/2008

OTHER PUBLICATIONS

Saudi Gazette, "Presidency provides electric vehicle to transport elderly, disabled at Grand Mosque", Nov. 9, 2022.
About Islam & News Agencies, "New Electric Vehicles to Help Elderly Pilgrims in Makkah", Dec. 13, 2018.

* cited by examiner

*Primary Examiner* — Scott A Browne
(74) *Attorney, Agent, or Firm* — Nath, Goldberg & Meyer; Richard C. Litman

(57) ABSTRACT

A train system for moving people within a religious site includes an elevated train track forming a closed loop within the religious site. An object of attention is located at a middle of the closed loop. The train system also includes at least one train on the elevated train track, at least one passenger platform for embarkation of at least one passenger onto the train, and at least one passenger platform for disembarkation of the at least one passenger from the train. The at least one train includes at least one carriage has an inside having a floor, a first seat located closer to the object of attention, and a second seat next to the first seat and farther away from the object of attention. The first seat and second seat have different distances from the floor of the carriage.

11 Claims, 5 Drawing Sheets

TRAIN FOR RELIGIOUS SITE

BACKGROUND

1. Field

The present disclosure is directed to a train system located at a religious site, in particular the present disclosure is drawn to a train system for moving people within the Grand Mosque in Mecca, Saudi Arabia.

2. Description of the Related Art

People of all religions may take pilgrimages to sites that are considered holy within their particular religion. For example, people of Muslim faith, Jewish faith, or Christian faith might travel to the city of Jerusalem in Israel because the Old City of Jerusalem has religious and historical significance to each of those religions.

For people of the Muslim faith, the most important pilgrimage to be made is the Hajj, a pilgrimage to the holy city of Mecca, Saudi Arabia. During Hajj at the Grand Mosque in Mecca, Muslims perform the ritual of tawaf. The ritual of tawaf involves circumambulation around the Kaaba, located in the center of the Grand Mosque. Muslims circumambulate seven times in a counterclockwise direction around the Kaaba. However, because the Hajj is so important in the Muslim faith, many people pilgrimage to Mecca, creating large crowds of people around the Kaaba, making it difficult for people in wheelchairs and with other mobility issues to circumambulate around the Kaaba. Thus, there is a need to create a system that allows people in wheelchairs and with other mobility issues to more easily circumambulate around the Kaaba in the Grand Mosque.

SUMMARY

The present disclosure is directed to a system that alleviates the issues for people in wheelchairs and with other mobility issues when on a pilgrimage at a religious site. In particular, the present disclosure is directed to a train system for moving people within a religious site. The train system includes an elevated train track forming a closed loop within the religious site. An object of attention is located at a middle of the closed loop formed by the elevated train track.

The present train system also includes at least one train on the elevated train track. The at least one train has at least one carriage having an inside, with the inside of the at least one carriage having a floor, a first seat located closer to the object of attention, and a second seat next to the first seat and farther away from the object of attention. The first seat and second seat have different distances from the floor of the carriage.

The present train system further includes at least one passenger platform for embarkation of at least one passenger onto the at least one train, and at least one passenger platform for disembarkation of the at least one passenger from the at least one train.

Other features and advantages of the train system of the present subject matter will be made clear in the following descriptions of the various embodiments and elements.

BRIEF DESCRIPTION OF THE DRAWINGS

Similar reference characters denote corresponding features consistently throughout the attached drawings.

DETAILED DESCRIPTION OF THE PREFERRED EMBODIMENTS

There is a need for a system for helping the infirm move around religious sites, whether those sites are important in Islam, Christianity, Judaism, Buddhism, or any other religion. Some religious sites cover vast areas. Some religious rituals involve movements of people, often many people at one time. In these situations, it is often difficult for people in wheelchairs or with other mobility issues to travel within the religious site and/or partake in the specific religious rituals.

The present disclosure is directed to a train system for moving people within a religious site, thus making it easier for people in wheelchairs or with other mobility issues to move about the religious site and to partake in the religious rituals. In a specific non-limiting embodiment, the religious site is the Grand Mosque in Mecca, Saudi Arabia and the religious ritual involves circumambulation around the Kaaba at the Grand Mosque. However, it is contemplated that the present train system could be implemented in any religious site large enough to stage the present train system and the religious ritual could be any ritual that involves the movement of people, especially large amounts of people at one time.

Figure 1A:
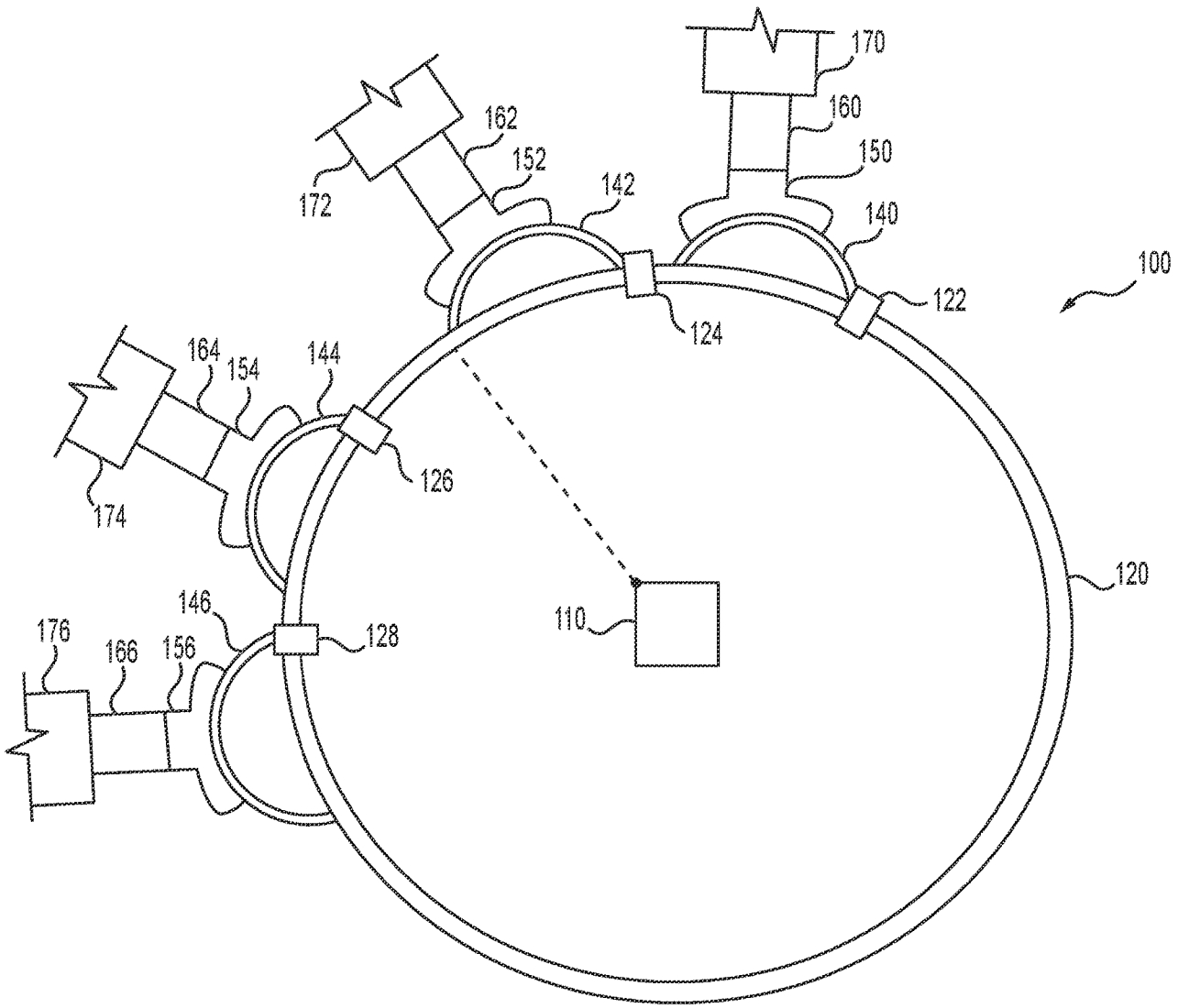
FIG. 1A is a schematic drawing of a train system in accordance with a non-limiting embodiment of the present subject matter.

FIG. 1A is a schematic representation of the train system located in a religious site of the present disclosure. Train system 100 includes elevated train track 120 forming a closed loop within the religious site. An object of attention 110 is located at a middle of the closed loop. In a particular non-limiting embodiment, object of attention 110 is the Kaaba within the Grand Mosque. However, object of attention 110 may be any object around which pilgrims may have an interest in moving around.

Train system 110 also includes at least one train on elevated train track 120. FIG. 1A does not show train 130 on elevated train track 120; however, details of non-limiting train 130 are provided below with respect to FIGS. 1B and 2. Train system 100 includes at least one train 130, however it is contemplated that multiple trains can be present on elevated train track 120 at one time, thus allowing more people to circumambulate object of attention 110 at the same time. In a particular embodiment, the number of trains 130 on elevated track at one time is at least five trains. A central control room located at another part of the religious site controls the movement of the trains. Also, the design of train system 100 (as well as the control room) are consistent with the architectural design of the religious site, so that pilgrims welcome the train to help the infirm perform the religious rituals. Furthermore, the elevation of the train, tracks and various platforms discussed herein preserves as much space as possible around the object of attention 110 so as many people as possible can still perform the religious rituals and not be limited by train system 100.

Figure 1B:
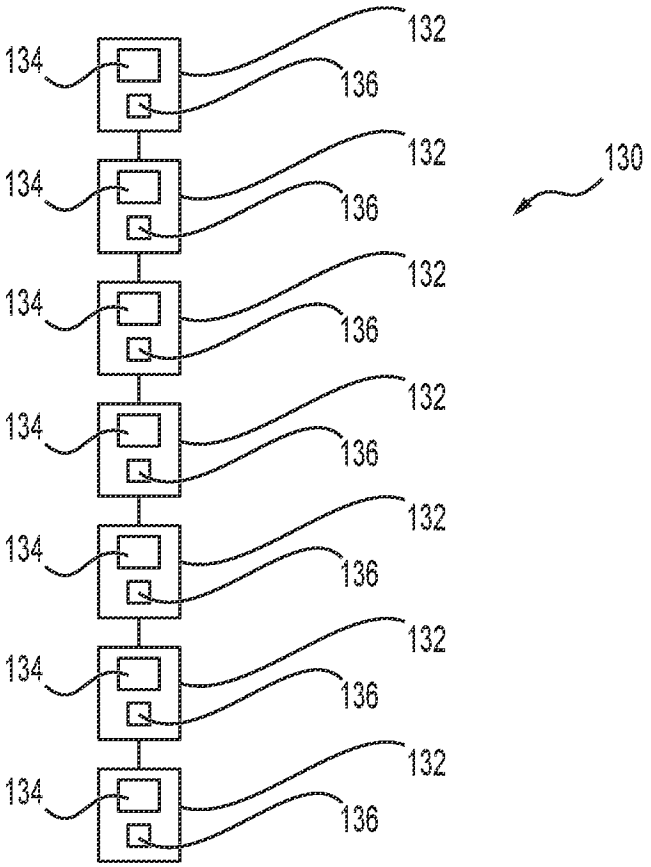
FIG. 1B is a schematic of a train useful in a particular non-limiting embodiment of the present train system.
Figure 2:
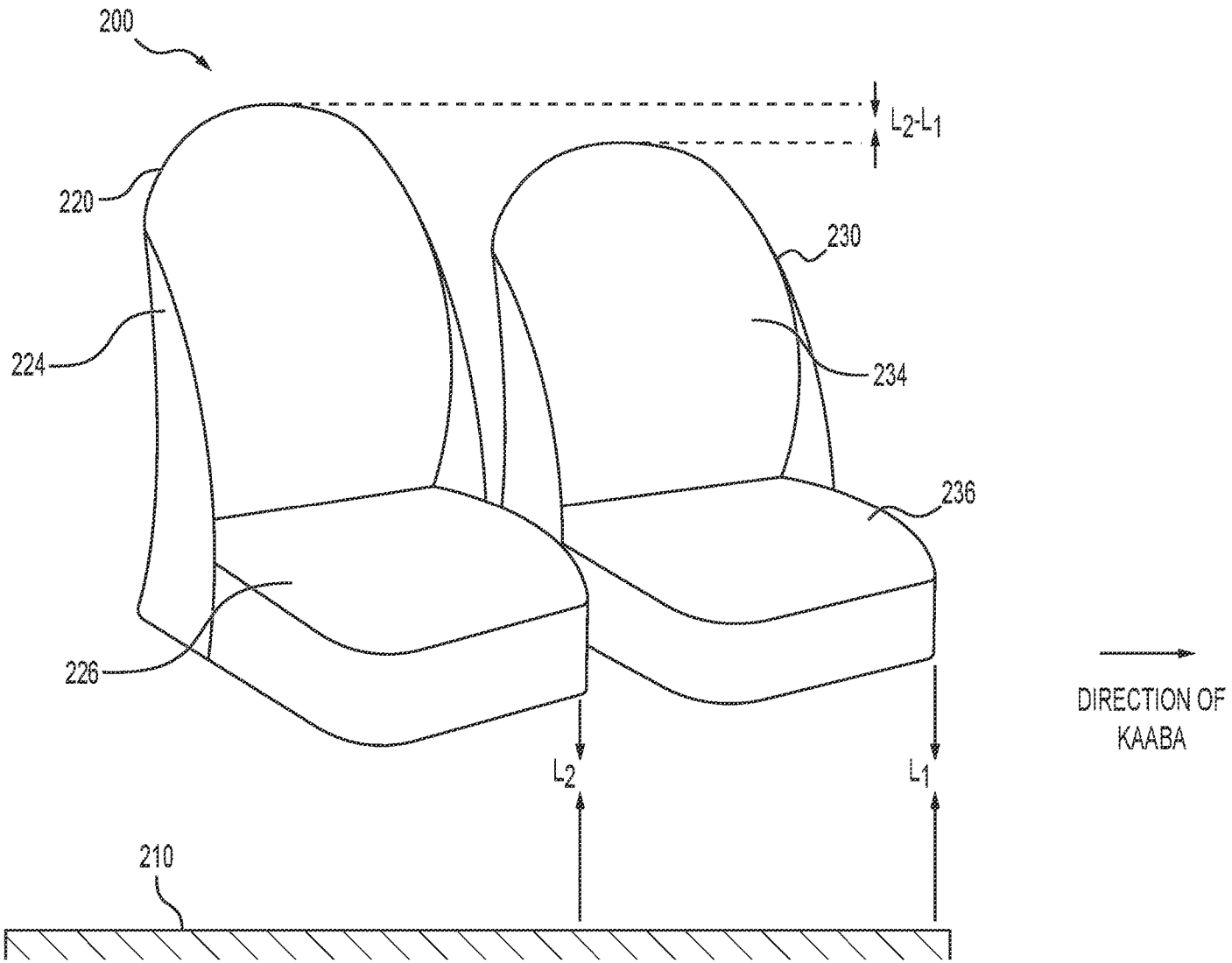
FIG. 2 is a simplified schematic of an inside of a carriage of the train of FIG. 1B.

As indicated above, train system 100 includes at least one train 130 for helping passengers or pilgrims circumambulate object of attention 110. FIGS. 1B and 2 provide more details of train 130. In particular, FIG. 1B is a schematic figure depicting train 130. Train 130 includes at least one carriage 132 having an inside. Train 130 has multiple carriages 132. FIG. 1B shows train 130 as having seven carriages 132, but it is contemplated that fewer or more than seven carriages can be used per train 130. Train 130 is an electric train, as this feature allows the train to be more silent as it moves within the religious site. In a particular embodiment, train 130 is powered by one or more photovoltaic panel 134 located on the roof of carriage 132. Photovoltaic panel 134 is connected to battery 136, with battery 136 helping to power train 130. FIG. 1B shows each carriage having its own photovoltaic panel 134 and battery 136, however it is also contemplated that fewer photovoltaic panels 134 and/or batteries 136 may be needed to power each train 130. Depending on the number of carriages per train, it may be possible to power the train using only one or two photovoltaic panels 134 or batteries 136. Also, a one-to-one correlation between photovoltaic panels and batteries is shown herein, but multiple photovoltaic panels may supply energy to a single battery.

FIG. 2 is a schematic figure depicting details of inside 200 of the at least one carriage. Inside 200 of the carriage includes floor 210, first seat 230 located closer to object of attention 110, and second seat 220 next to the first seat and farther away from object of attention 110, listed as the Kaaba in FIG. 2. First seat 230 includes first seat back 234 and first seat chair 236, while second seat 220 includes second seat back 224 and second seat chair 226. First seat 230 and second seat 220 have different heights or distances from floor 210 of the carriage. First seat 230 has a distance $L_1$ from floor 210 to first seat chair 236, while second seat 220 has a distance $L_2$ from floor 210 to second seat chair 226. Thus, the difference in height is given by $L_2$-$L_1$.

The difference in height allows a passenger seated in second seat 220 to see over the passenger in first seat 230 when looking towards object of attention 110 without having to rise out of their seat. As such, it is contemplated that $L_2$-$L_1$ is sufficiently large to accomplish this unobstructed view of the passenger in second seat 220 when there is also a passenger in first seat 230. A difference in height of 5-10 centimeters is sufficient to provide this advantage. In a non-limiting embodiment, $L_2$ is 45 centimeters and $L_1$ is 40 centimeters, thereby providing a difference in height of 5 centimeters.

Train system 100 includes at least one passenger embarkation platform 154 for embarkation of at least one passenger onto the at least one train 130. Train system 100 also includes at least one passenger disembarkation platform 150 for disembarkation of the at least one passenger from the at least one train. FIG. 1A shows a plurality of passenger embarkation platforms 154, 156 and a plurality of passenger disembarkation platforms 150, 152. While two passenger embarkation platforms and two passenger disembarkation platforms are depicted in FIG. 1A, the present subject matter is not limited to two of the respective passenger platforms, as three or more of such passenger embarkation platforms and passenger disembarkation platforms can be used within the train system of the present subject matter.

Trains 130 can move along elevated train track 120 in either a clockwise direction or a counterclockwise direction. The positioning of first seat 230 and second seat 220 within carriage 132 depends on the direction train 130 is traveling on elevated train track 120. First seat 230, being designated as the seat lower in height, is always closest to object of attention 110 in order to allow a passenger in the higher seat to see object of attention 110 over a passenger seated in the lower seat. In the embodiment depicted in FIG. 1A, the train travels in a counterclockwise direction as object of attraction 110 is Kaaba and the religious site is the Grand Mosque.

Figure 3:
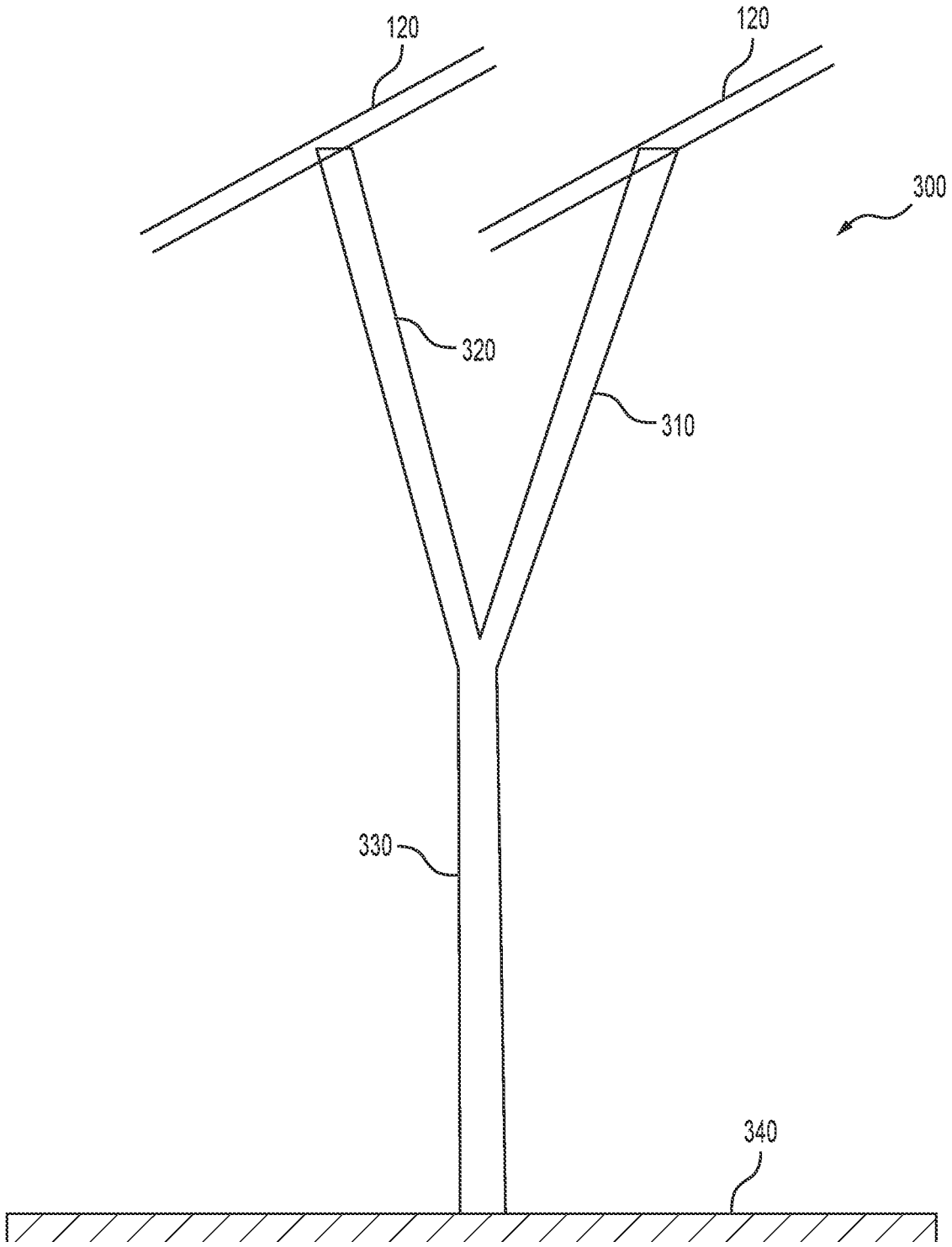
FIG. 3 is a schematic of a support structure for supporting the elevated train tracks of the present train system.

The elevated aspect of train system 100 allows more people to circumambulate around object of attention 110 by not taking up ground space around object of attention 110. In order to accomplish such elevation, elevated train tracks 120 is supported by a plurality of train track support structures. FIG. 3 depicts a non-limiting embodiment of such a train track support structure 300. Train track support structure 300 includes support base 330 supported by ground 340, as well as including first support branch 310 and second support branch 320, each of which are connected to support base 310 at the same point, thereby forming a general "Y" shape for train track support structure 300. First support branch 310 and second support branch 320 each support an individual rail of elevated train track 120. The length of support base 330 is generally the same as the length of each support branch 310, 320. In a non-limiting embodiment, the length of each of support base 330, first support branch 310, and second support branch 320 is about 2 meters.

The architectural design of each train track support structure 300 is consistent with the overall design of the religious site. In a particular embodiment, train track support structure is made of steel, however any suitable material can be used so long as the material is strong enough to support elevated train track 120 and all of the trains thereon. It is contemplated that the distance between each train track support structure 300 within the religious site will be 5-8 meters, more generally about 7 meters.

As trains move along elevated train track 120, the trains do not want to be delayed while other trains are loading and unloading passengers. Therefore, elevated train track 120 includes first track branch 144 connecting elevated train track 120 to passenger embarkation platform 154, second track branch 146 connecting elevated train track 120 to passenger embarkation platform 156, third track branch 140 connecting elevated train track 120 to passenger disembarkation platform 150, and fourth track branch 142 connecting elevated train track 120 to passenger disembarkation platform 152. The track branches allow trains to detour from elevated train track 120 to the various passenger platforms without disrupting the movement of other trains on elevated train track 120. In order to divert the trains from elevated train track 120, diverters 126, 128, 122, 124, respectively, are positioned at each branch point. Diverters 126, 128, 122, 124 are controlled by the operator located in the central control room. Diverters 126, 128, 122, 124 can be train track switches that allow the trains to switch tracks from elevated train track 120 to the respective track branch.

There may be situations where the religious site has buildings or structures that are positioned to allow passengers easy access to the passenger embarkation platforms and passenger disembarkation platforms. In some such situations, the buildings or structures located at the religious site may facilitate the erection of additional platforms to make movement of passengers and pilgrims easier. FIG. 1A shows examples of such religious site platforms 174, 176, 170, 172 being associated with the respective passenger embarkation platforms and passenger disembarkation platforms. In particular, FIG. 1A shows first religious site platform 174 associated with first passenger embarkation platform 154, second religious site platform 176 associated with second passenger embarkation platform 156, third religious site platform 170 associated with first passenger disembarkation platform 150, and fourth religious site platform 172 associated with second passenger disembarkation platform 152. The respective religious site platform is located near to, and at a height equal to, the respective passenger embarkation platform or passenger disembarkation platform.

In situations where the religious site allows religious site platforms to be erected, it often results in the need for a bridge to be built from the religious site platform to the passenger embarkation platform or passenger disembarkation platform, thus allowing passengers and pilgrims to move from the religious site platform to the passenger embarkation platform or vice versa. FIG. 1A shows such bridges 164, 166, 160, 162 connecting the various religious site platforms to their respective passenger embarkation platform or passenger disembarkation platform. In particular, first bridge 164 connects first religious site platform 174 to first passenger embarkation platform 154, second bridge 166 connects second religious site platform 176 to second passenger embarkation platform 156, third bridge 160 connects third religious site platform 170 to first passenger disembarkation platform 150, and fourth bridge 162 connects fourth religious site platform 172 to second passenger disembarkation platform 152.

Figure 4:
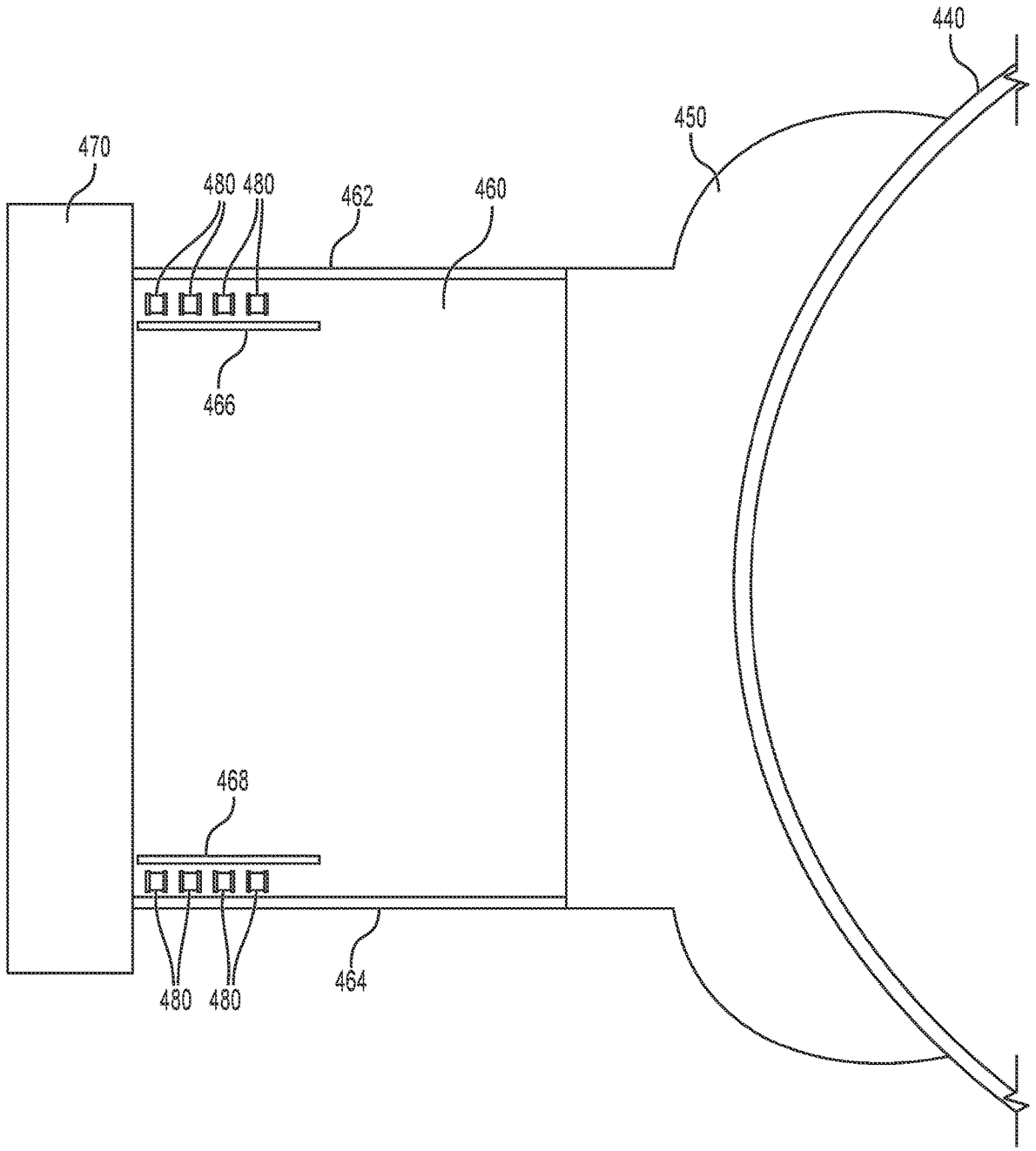
FIG. 4 is a schematic showing details of a bridge connecting a religious site platform to a passenger embarkation platform in accordance with a particular embodiment of the present train system.

FIG. 4 is a schematic drawing of a particular non-limiting embodiment of a bridge from the religious site platform to a passenger embarkation platform. In FIG. 4, bridge 460 connects religious site platform 470 to passenger embarkation platform 450. Passengers and pilgrims wait on passenger embarkation platform 450 while waiting for a train that comes on track branch 440. Bridge 460 includes a pair of outer rails 462, 464 as a safety measure to keep passengers and pilgrims from falling off bridge 460. Each of outer rails 462, 464 span the length of bridge 460 from religious site platform 470 to passenger embarkation platform 450.

Bridge 460 also includes a pair of inside rails 466, 468 associated with outer rails 462, 464, respectively. Each of inside rails 466, 468 span a shorter length of bridge than their corresponding outside rail 462, 464. In a particular embodiment, the length of inside rails 466, 468 is about half of the length of outside rails 462, 464. Inside rails 466, 468 are spaced apart from their respective outside rails 462, 464, thereby forming a space between outside rail 462 and inside rail 466, and a space between outside rail 464 and inside rail 468. The spaces created between the outside rails and the inside rails is sufficiently large to accommodate a number of wheelchairs 480 that have been folded to conserve space. This allows easy storage of wheelchairs 480 as the passenger rides the train around the object of attention 110. The spacing of the various platforms from each other allows the wheelchair user to quickly and efficiently retrieve the wheelchair after circumambulating the object of attention. As a wheelchair is pushed into the space between the outer rail and the inner rail, the wheelchair pushes forward any wheelchairs already within the space so that the user's wheelchair is at the front of the line by the time the user retrieves the wheelchair from the space, having been pushed by subsequently arriving wheelchairs.

While the particular embodiment in FIG. 1A shows a specific number of platforms and bridges, it is understood that the embodiment is for illustrative purposes only and any number of platforms and bridges fall within the scope of the present disclosure. In other words, the present disclosure is not meant to be limited by the specific number of platforms and bridges described therein.

It is to be understood that the system and method for attributing content is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A train system for moving people within a religious site, comprising:

an elevated train track forming a closed loop within the religious site, an object of attention being located at a middle of the closed loop;

at least one train on the elevated train track, the at least one train comprising at least one carriage having an inside, the inside of the at least one carriage comprising a floor, a first seat located closer to the object of attention, and a second seat next to the first seat and farther away from the object of attention, whereby the first seat and the second seat have different distances from the floor of the carriage;

at least one passenger embarkation platform for embarkation of at least one passenger onto the at least one train;

at least one passenger disembarkation platform for disembarkation of the at least one passenger from the at least one train;

a first religious site platform associated with the at least one passenger embarkation platform; and a first bridge connecting the first religious site platform to the at least one passenger embarkation platform.

2. The train system according to claim 1, wherein the elevated train track comprises:

a first track branch connecting the elevated train track to the at least one passenger embarkation platform; and a second track branch connecting the elevated train track to the at least one passenger disembarkation platform.

3. The train system according to claim 2, further comprising:

a first diverter positioned to divert the at least one train from the elevated track to the first track branch; and a second diverter positioned to divert the at least one train from the elevated track to the second track branch.

4. The train system according to claim 1, further comprising a plurality of trains simultaneously on the elevated train track.

5. The train system according to claim 1, further comprising a plurality of passenger embarkation platforms and a plurality of disembarkation platforms.

6. The train system according to claim 5, further comprising:

a plurality of first track branches, each of the plurality of first track branches connecting the elevated train track to each of the plurality of passenger embarkation platforms; and a plurality of second track branches, each of the plurality of second track branches connecting the elevated train track to each of the plurality of passenger disembarkation platforms.

7. The train system according to claim 1, wherein at the least one train comprises a photovoltaic panel on a roof of the at least one carriage and a battery connected to the photovoltaic panel, the battery configured to store energy produced by the photovoltaic panel.

8. The train system according to claim 1, wherein the first bridge comprises:

at least one outside rail spanning a distance of the bridge from the first religious site platform to the at least one passenger embarkation platform; and at least one inside rail spaced about from the outside rail and spanning a distance between the first religious site platform and the at least one passenger embarkation platform, the distance spanned by the at least one inside railing being shorter than the distance spanned by the at least one outside rail; wherein the at least one outside rail and the at least one inside rail from a space therebetween.

9. The train system according to claim 8, further comprising:

a plurality of passenger embarkation platforms;

a plurality of religious site platforms; and a plurality of bridges, each bridge connecting one of the plurality of religious site platforms to one of the plurality of passenger embarkation platforms.

10. The train system according to claim 9, wherein each of the plurality of bridges comprises:

at least one outside rail spanning a distance of the bridge from one of the plurality of first religious site platforms to one of the plurality of passenger embarkation platforms; and at least one inside rail spaced apart from the outside rail and spanning a distance between the one of the plurality of religious site platforms and the one of the plurality of passenger embarkation platforms, the distance spanned by the at least one inside frail being shorter than the distance spanned by the at least one outside rail.

11. The train system according to claim 1, further comprising a plurality of train track supports for supporting the elevated train track, each of the plurality of train track supports comprising a support base, a first support branch connected to the support base, and a second support branch connected to the support base, wherein the train track is supported on the first support branch and the second support branch.

* * * * *